US006361141B1

(12) United States Patent
Baitz

(10) Patent No.: US 6,361,141 B1
(45) Date of Patent: Mar. 26, 2002

(54) INK JET PRINTER WITH A NOZZLE COVERING AND CLEANING DEVICE

(75) Inventor: Guenter Baitz, Berlin (DE)

(73) Assignee: Siemens Nixdorf Informationssysteme AG, Paderborn (DE)

( * ) Notice: Subject to any disclaimer, the term of this patent is extended or adjusted under 35 U.S.C. 154(b) by 0 days.

(21) Appl. No.: 09/446,643

(22) PCT Filed: Mar. 26, 1998

(86) PCT No.: PCT/DE98/00890

§ 371 Date: Dec. 22, 1999

§ 102(e) Date: Dec. 22, 1999

(87) PCT Pub. No.: WO99/00253

PCT Pub. Date: Jan. 7, 1999

(30) Foreign Application Priority Data

Jun. 25, 1997 (DE) ..... 197 26 971

(51) Int. Cl.[7] ..... B41J 2/165

(52) U.S. Cl. ..... 347/32; 347/29; 347/33

(58) Field of Search ..... 347/32, 29, 33, 347/23

(56) References Cited

U.S. PATENT DOCUMENTS 5,963,228 A * 10/1999 Purwins ..... 347/31

* cited by examiner

*Primary Examiner*—N. Le
*Assistant Examiner*—Shih-Wen Hsieh
(74) *Attorney, Agent, or Firm*—Schiff Hardin & Waite

(57) ABSTRACT

A description is given of an ink jet printer having an ink jet print head which can be displaced parallel to a print line, and a print backing support used to support a recording medium, a covering device and a cleaning device for the ink nozzles of the ink jet print head. The covering device, the cleaning device and a supporting section for the recording medium are arranged on a rotatable disk within the printing area of the ink jet print head.

11 Claims, 2 Drawing Sheets

INK JET PRINTER WITH A NOZZLE COVERING AND CLEANING DEVICE

BACKGROUND OF THE INVENTION

The invention relates to an ink jet printer with a covering and cleaning device for the ink nozzles of an ink jet print head, which covering and cleaning device are mounted on a segment of a periphery of a disk, which is arranged in the area of the ink jet printer and which rotates on an axis extending through a circle.

An ink jet printer with a covering and cleaning device for the ink nozzles of an ink jet print head is disclosed by DE-C-36 11 666. Described in this document is an ink jet print head which can be displayed parallel to a print line and a roll-like print backing support used to support a recording medium opposite the ink jet print head and aligned parallel to the print line. Arranged alongside the printing area, that is to say the maximum area which can be assumed by the recording medium and the maximum area which can be printed by the ink jet print head, is a parking area having a covering device and a cleaning device for the ink nozzles of the ink jet print head.

As a result of the parking area, the printer obtains a width which cannot be accepted in many applications. This applies in particular to cashdesk printers of the type as described, for example, in the German patent application 197 09 941.6. Such cashdesk printers are often installed in a cutout in a cashdesk, so that for their outline a quasi-standard has been formed, having a width dimension which is only slightly greater than the width of the largest document to be printed with the printer. This document is in DIN A4 format, that is to say has a width of 210 mm. In printers of this class, the ink jet printing principle has therefore not been used hitherto.

It has already been proposed, in U.S. Pat. No. 5,051,761, to fit the covering device and the cleaning device on the periphery of a circular or circular-segment-like disk arranged in the printing area of the ink jet print head, and it is possible for the disk to rotate about an axis extending through the center of the circle. In this case, the recording medium is supported in the printing area by an endless transport belt, which is stretched out between two deflection rollers. One of these transport rollers—as viewed in the transport direction of the recording medium—is arranged upstream of the printing area and the other is arranged downstream of the latter. Cut out of the transport belt is a window, through which the covering device or the cleaning device act on the ink jet print head if the disk is lifted in the direction of the printing area. The arrangement comprising transport belt and deflection rollers is complicated and needs a relatively great amount of space. Added to this is the fact that the transport belt firstly has to be brought into a specific peripheral position relative to the ink jet print head before the covering device or the cleaning device can act on the ink jet print head. This requires additional monitoring devices and control measures for positioning the transport belt, and makes the printer slower, since the recording medium must have left the transport belt before the window can be brought into the area of the ink jet print head.

SUMMARY OF THE INVENTION

The object of the invention is to provide an ink jet printer having a covering and cleaning device arranged in the printing area of the ink jet print head for the ink nozzles of the ink jet print head, and to propose a supporting device, for a recording medium, which can be brought into the printing area instead of the covering and cleaning device.

The object is achieved by an improvement which is that a disk with the covering device and the cleaning device in position in a gap between two parts of a print backing support, and has a supporting section for the recording medium arranged on a segment of the periphery which can be rotated into position during printing.

The covering device and the cleaning device are arranged in the printing area of the ink jet print head. The fact that the covering device, the cleaning device and the supporting section for the recording medium are arranged on the periphery of a circular or circular-segment-like disk which can be rotated about an axis extending through the center of the circle, means that no additional space is needed for a parking area outside the printing area or upstream and downstream of the ink jet print head. The disk can be arranged in the printing area anywhere within the print line. As a result of the rotation of the disk about its axis, the covering device can be brought in front of the nozzle plate of the ink jet print head, the cleaning device can be moved past the nozzle plate, or the supporting section can be pivoted into the printing area. Since the covering device must in any case be pivoted away in front of the nozzle plate before a printing operation, the supporting section can be brought into the printing area without additional effort by simply rotating the disk further.

The axis can be aligned either parallel to the print backing support or perpendicular thereto and parallel to the plane of the recording medium.

The disk is preferably rotated by a motor, in particular a stepping motor. In the latter case, the angular position of the disk can be fixed simply by counting the motor stepping pulses. The drive to the disk is preferably provided via a toothing system, at least on part of its periphery, which meshes with a gear wheel driven by the motor.

In a preferred development of the invention, the disk can be displaced along the print backing support. As a result, in the case of a cashdesk printer having a receipt printing station, such as is disclosed by the German patent application 197 09 941.6, the disk can be displaced into the part of the printing area which is not occupied by the receipt paper strip. If a receipt printing station and a journal printing station are used alongside each other, the disk can be brought into the gap between the receipt paper strip and the journal paper strip.

In order to ensure that the covering device is lifted perpendicularly off the nozzle plate of the ink jet print head, the covering device is connected to the disk via a radially adjustable slider, and fixed to the slider is a control pin which is guided in a snail-shaped or spiral control curve arranged in the ink jet printer and surrounding the axis. The control curve is formed on a control plate which is held on the axis and is stationary with respect to the disk, that is to say does not rotate together with the disk.

Further features and advantages of the invention emerge from the following description which, in conjunction with the appended drawings, explain the invention using exemplary embodiments.

DESCRIPTION OF THE PREFERRED EMBODIMENTS

Figure 1:
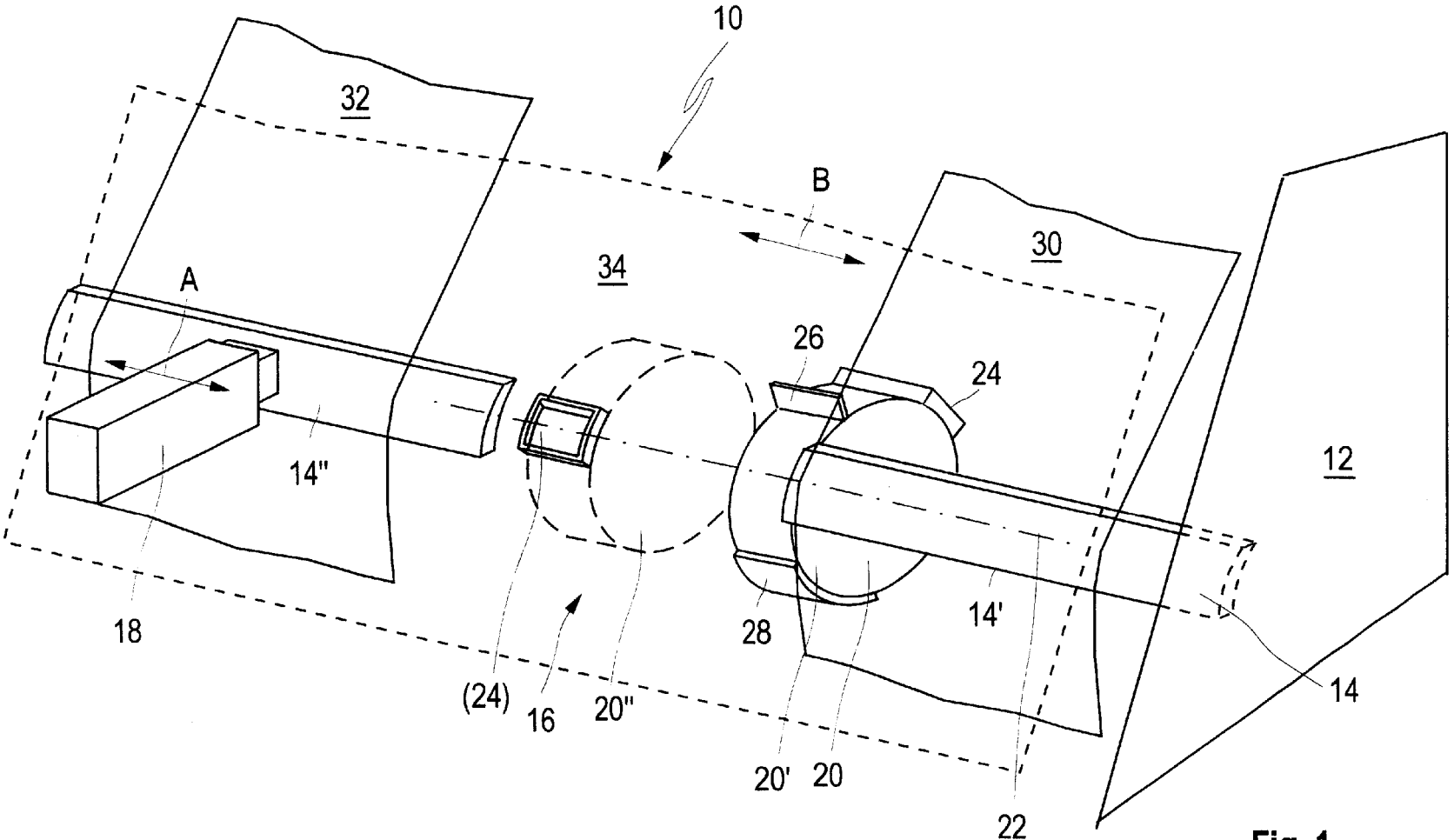
FIG. 1 shows a first exemplary embodiment of an ink jet printer in a schematic, perspective front view.
Figure 2:
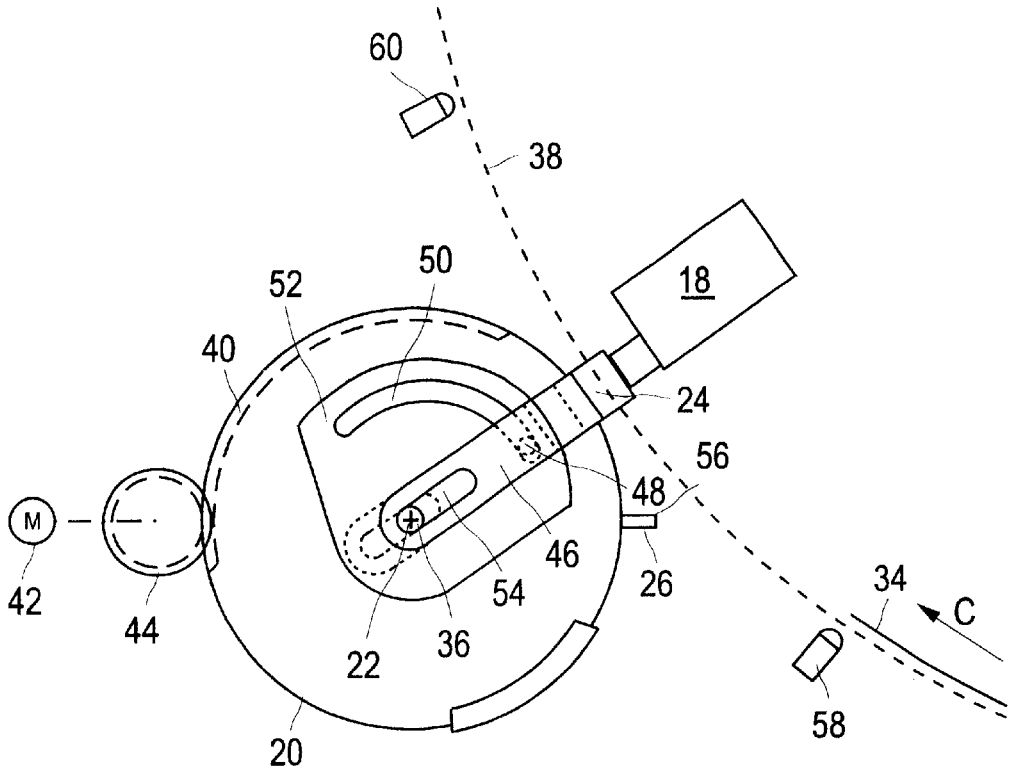
FIG. 2 shows a schematic side view of the ink jet printer illustrated in FIG. 1.

Illustrated in FIG. 1 is a first exemplary embodiment of an ink jet printer 10 in a schematic, perspective front view, in which all the parts of the printer which are not relevant to the invention have been left out. In the figure, one side wall of a printer frame is designated by 12. A bar-like print backing support 14 projects, perpendicular to the surface, from that side of the side wall 12 that points toward the interior of the printer. This print backing support is divided by a gap 16 in the central area of the ink jet printer into two parts 14', 14". The print backing support 14 is formed on a paper guide surface 38 (FIG. 2). An ink jet print head 18 is mounted such that it can be displaced along the print backing support 14 and parallel to the latter in the direction of a double arrow A, forming a print line.

In the gap 16, a cylindrical disk 20 is mounted such that it can rotate about an axis 22, which coincides with the axis of the cylinder. The axis 22 extends parallel to the print backing support 14 and on its side facing away from the ink jet print head 18. Arranged on the periphery of the disk 20, in each case offset at an angle from one another, are a covering device 24, a cleaning device 26 and a supporting section 28. The covering device 24 has the form of a cap that is open with respect to the nozzle plate of the ink jet print head 18 and consists of a resiliently deformable, ink-resistant plastic or rubber. The cleaning device 26 has the shape of a plate which projects radially from the peripheral surface of the disk 20 and is aligned axially. It is likewise formed from a resiliently deformable, ink-resistant plastic or rubber. The supporting section 28 is a section of enlarged disk diameter. It extends over the entire width of the disk 20. If the latter is rotated in such a way that the supporting section 28 is opposite the ink jet print head 18, the surface of the supporting section 28 is flush with the print backing support 14.

The disk 20 can be displaced within the gap 16 in the direction of a double arrow B, between the positions 20' (illustrated with continuous lines) and 20" (drawn dashed). In the position 20", the disk 20 is illustrated in an angular position in which the covering device 24 faces the ink jet print head 18. In this angular position, the cap-like shape of the covering device 24 can be seen. The fact that the disk 20 can be displaced makes it possible to use receipt paper strips 30 or journal paper strips 32 of different widths. The setting of the disk 20 when printing a counterfoil 34 which extends over the gap 16 will be described further below.

FIG. 2 shows a schematic side view of the ink jet printer 10 illustrated in FIG. 1. The disk 20 is mounted on a coaxial shaft 36. In addition, in its peripheral area facing away from the paper guiding surface 38, it is provided with a toothing system 40, which meshes with a gear wheel 44 that can be driven by a stepping motor 42.

The covering device 24 is arranged at one end of a slider 46 which can be adjusted radially in relation to the disk 20 and which can be rotated together with the disk 20. Fastened to the slider 46 is a control pin 48, which is aligned parallel to the shaft 36 and is guided in a spiral shaped groove forming a snail-like control curve 50 which surrounds the axis 22. This control curve or cam surfaced is in turn formed on a control plate 52 which is held on the axis 22 and is stationary with respect to the disk 20, that is to say does not rotate together with the latter. In the region of the shaft 36, the slider 46 is provided with a slot 54, with which it is mounted on the shaft 36 such that it can be displaced longitudinally.

If the disk 20 is rotated in the counterclockwise direction, the control pin 48 runs along in the control curve 50. In the process, the slider 46 is displaced radially in the direction of the axis 22, so that the covering device 24 is lifted off the nozzle plate of the ink jet print head 18 and is pivoted away upward in front of the latter. If the disk 20 is rotated further, the cleaning device 26 comes into the area of the ink jet print head 18. In the process, it is deflected resiliently, so that its leading edge 56, aligned parallel to the axis 22, sweeps over the nozzle plate of the ink jet print head 18 and in so doing wipes off contaminants adhering to the latter. The cleaning action can be increased further by rotating the disk 20 to and fro many times. For the purpose of printing, the disk 20 is rotated further until the supporting section 28 is opposite the printing area 18. The latter can then be displaced in the print line direction over the entire printing area.

If a counterfoil 34 which extends over the gap 16 is to be printed, the disk 20 is controlled in the following way, starting from the position illustrated in FIG. 2, in which the printing area 18 is covered: the leading edge of a document 34 fed to the ink jet printer 10 in the direction of the arrow C is detected by a first light barrier 58 arranged upstream of the print backing support 14, whereupon a document transport device (not illustrated) is stopped. The disk 20 is then rotated as described above until the supporting section 28 is opposite the ink jet print head 18. As a result, the gap 16 is largely closed, so that the document 34 is also supported in this area. The fact of reaching this position is determined using the number of pulses supplied to the stepping motor 42, and the document transport device is therefore enabled. Following the printing of the document 34, the latter is transported out of the ink jet printer 10 either in or counter to the direction of the arrow C. The document 34 has certainly left the ink jet printer 10 when neither the first light barrier 58 nor a second light barrier 60 arranged above the print backing support 14 reports the presence of a document. The disk 20 is then rotated back in the clockwise direction into the position in which the covering device 24 covers the nozzle plate of the ink jet print head 18, which is again determined using the number of pulses supplied to the stepping motor 42.

Figure 3:
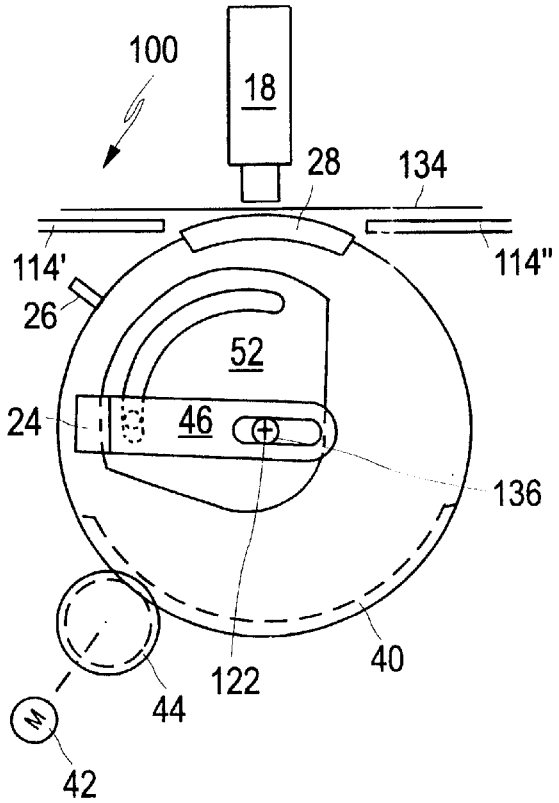
FIG. 3 shows a second exemplary embodiment of an ink jet printer in a schematic plan view.

FIG. 3 shows a second exemplary embodiment of an ink jet printer 100 in a schematic plan view. This differs from the ink jet printer 10 illustrated in FIGS. 1 and 2 in the fact that the axis 122 and therefore the shaft 136 of the disk 120 are aligned perpendicular to the print backing support 114', 114" and parallel to the plane of a recording medium 134. The disk 120 is shown in its position ready to print, but otherwise the arrangement is identical to that shown in FIG. 2. Identical positions are therefore identified by identical reference symbols.

I claim:

1. An ink jet printer having an ink jet print head with ink nozzles, said print head being displaceable parallel to a print line, and a print backing support used to support a recording medium positioned opposite the ink jet print head and aligned parallel to the print line, a covering device and a cleaning device for the ink nozzles of the ink jet head, the covering device and cleaning device being arranged on a portion of a periphery of a disk having at least the shape of a circular segment, said disk being rotatable about an axis extending through the center of said circular segment, the print backing support being divided by a gap into two parts, the disk being located in the gap and having a supporting section for the recording medium being arranged on the periphery of the disk.

2. An ink jet printer according to claim 1, wherein the axis of the disk is aligned parallel to the print backing support and parallel to the recording medium.

3. An ink jet printer according to claim 1, wherein the axis of the disk is aligned perpendicular to the print backing support and parallel to the plane of the recording medium.

4. An ink jet printer according to claim 1, wherein the disk can be rotated by a motor.

5. An ink jet printer according to claim 4, wherein the motor is a stepping motor.

6. An ink jet printer according to claim 4, wherein the disk has a toothing system on at least a part of its periphery, which meshes with a gear wheel driven by said motor.

7. An ink jet printer according to claim 1, wherein the disk can be displaced along the print backing support.

8. An ink jet printer according to claim 1, wherein the covering device is connected to the disk by a radially adjustable slider, said slider being fixed to a control pin which is guided in a spiral-shaped control groove which surrounds the axis and is formed on a contact plate which is held on the axis and is stationary with respect to the disk.

9. An ink jet printer according to claim 1, wherein the covering device is cap-like.

10. An ink jet printer according to claim 1, wherein the cleaning device is plate-like and of a resilient deformable material and projects radially from a peripheral surface of the disk.

11. An ink jet printer according to claim 1, wherein the cleaning device is arranged between the covering device and the supporting section.

* * * * *